US007077491B2

(12) United States Patent
Lee

(10) Patent No.: US 7,077,491 B2
(45) Date of Patent: Jul. 18, 2006

(54) METHOD AND AN APPARATUS TO CONTROL PRINTING OPERATIONS IN AN INKJET PRINTER

(75) Inventor: Geun-chul Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 336 days.

(21) Appl. No.: 10/652,621

(22) Filed: Sep. 2, 2003

(65) Prior Publication Data

US 2004/0090479 A1 May 13, 2004

(30) Foreign Application Priority Data

Sep. 6, 2002 (KR) ..... 10-2002-0053812

(51) Int. Cl.
*B41J 29/393* (2006.01)

(52) U.S. Cl. ..... 347/19; 347/16

(58) Field of Classification Search ..... 347/19, 347/14, 16, 104, 105
See application file for complete search history.

(56) References Cited

U.S. PATENT DOCUMENTS 5,515,092 A 5/1996 Swanson et al.
6,079,807 A * 6/2000 Lindstrom et al. ..... 347/16
6,130,696 A 10/2000 Mashita et al.
6,416,679 B1 7/2002 Silverbrook
6,425,650 B1 * 7/2002 Walker et al. ..... 347/14
6,439,908 B1 8/2002 Silverbrook et al.

FOREIGN PATENT DOCUMENTS

| | | | |
|---|---|---|---|
| DE | 197 57 416 | A | 7/1999 |
| EP | 561051 | B1 | 9/1993 |
| EP | 622235 | B1 | 11/1994 |
| EP | 0 911 699 | A | 4/1999 |
| EP | 1 034 937 | A | 9/2000 |
| EP | 1 329 326 | A | 7/2003 |
| JP | 11-115270 | | 4/1999 |
| JP | 11-301049 | | 11/1999 |

* cited by examiner

*Primary Examiner*—Lamson Nguyen
(74) *Attorney, Agent, or Firm*—Stanzione & Kim, LLP

(57) ABSTRACT

A method and apparatus to control a printing operation in an inkjet printer. One or more kinds of user printing sheets are registered along with feature values of the user printing sheets. When a printing command is applied, a feature value of a fed printing sheet is obtained to determine a kind of the fed printing sheet. A head driver is controlled according to the determined kind of the fed printing sheet.

19 Claims, 5 Drawing Sheets

METHOD AND AN APPARATUS TO CONTROL PRINTING OPERATIONS IN AN INKJET PRINTER

CROSS-REFERENCE TO RELATED APPLICATIONS

This application claims priority from Korean Patent Application No. 2002-53812, filed on Sep. 6, 2002, in the Korean Intellectual Property Office, the disclosure of which is incorporated herein in its entirety by reference.

BACKGROUND OF THE INVENTION

1. Field of the Invention

The present invention relates to an inkjet printer, and more particularly, to a method and an apparatus to control a printing operation according to whether a fed printing sheet belongs to at least one or more kinds of user printing sheets of which kinds and feature values are registered in advance.

2. Description of the Related Art

In inkjet recording apparatuses such as printers, copiers, facsimiles, plotters, or the like, an image is recorded by dropping ink droplets discharged from a head right onto a printing sheet, and then the ink is dried through the evaporation in the air or through permeation into the printing sheet. Due to the above recording methods, the characteristics of a printing surface of the printing sheet affect the image quality of a printed material.

Accordingly, before starting a printing operation, in a user interface, a user can select one of an inkjet sheet mode, in which printing is performed on a coated sheet having a coat film capable of increasing the permeability of ink or a glossy sheet, and a general sheet mode, in which printing is performed on a general sheet not having a coat film. A printer controller controls a printer engine according to the selected sheet mode.

Meanwhile, an optical sensor is attached to a predetermined position of a feed tray. A firmware of the printer controller identifies the kind of a printing sheet fed into the feed tray based on light reflected from the fed printing sheet and the kind of a registered sheet from an identification table which defines the relationship between the registered sheet and light reflected from the registered sheet. The printer controller controls the printer engines depending on the kind of a printing sheet identified by a printer.

A method of controlling the printer engine according to the kind of the printing sheet will be described. For example, since an inkjet sheet has a higher ink permeability than a general sheet, when compared with the general sheet mode, in the inkjet sheet mode, a head rapidly scans light, a large number of sheets pass, a small number of nozzles are used at a time, and the volume of ink droplets is small.

However, the inkjet sheet mode and the general sheet mode vary according to the kind of inkjet recording apparatuses. Also, the printing sheet is made of different materials or light is reflected differently according to a position of the feed tray in which the optical sensor is installed and manufactured. Thus, errors may occur when the printer controller identifies the kinds of printing sheets.

SUMMARY OF THE INVENTION

The present invention provides a printing operation controlling method of controlling the operation of a print head in an inkjet printer according to the kind of a printing sheet determined by pre-registering feature values and kinds of at least one or more kinds of user printing sheets, and determining whether the printing sheet fed into a feed tray belongs to the kinds of the user printing sheets when a printing command is given.

The present invention also provides a printing operation controlling apparatus that is optimal to implement the printing operation controlling method.

According to an aspect of the present invention, there is provided a method of controlling a printing operation in an inkjet printer. The method includes: registering one or more kinds of user printing sheets along with feature values of the user printing sheets; obtaining a feature value of a fed printing sheet to determine a kind of the fed printing sheet when a printing command is applied; and controlling a head driver according to the determined kind of the fed printing sheet.

The registration of the kinds of the user printing sheets with the feature values includes: applying a sensing command for the fed printing sheet; obtaining a feature value of a printing sheet to be registered; applying a printing sheet registration command; and registering and storing the obtained feature value and a kind of the printing sheet corresponding to the obtained feature value.

The determination of the kind of the fed printing sheet includes: obtaining the feature value of the fed printing sheet when the printing command is applied; comparing the obtained feature value with the registered feature values in the registration of the feature values of the user printing sheets; determining the fed printing sheet as belonging to the registered kinds of the user printing sheets when the obtained feature value corresponds to the registered feature values; and identifying the kind of the fed printing sheet according to the feature value of the fed printing sheet and with reference to a predetermined identification table when the obtained feature value does not correspond to the registered feature values.

According to another aspect of the present invention, there is provided an apparatus to control a printing operation in an inkjet printer. The apparatus includes: a sensor obtaining a feature value of a fed printing sheet; a storage storing the feature value and the kind of user printing sheets corresponding to the feature value as a table; a system controller registering one or more kinds of user printing sheets along with feature values of the user printing sheets, and determining a kind of a fed printing sheet using a feature value of the fed printing sheet provided from the sensor and with reference to one of the table stored in the storage and an identification table included therein when a printing command is applied; and a print controller creating control data corresponding to the kind of the fed printing sheet determined by the system controller and controlling a head driver according to the control data.

The printing controlling method performed in the inkjet printer can be realized on a computer-readable recording medium on which a computer-executable program is recorded. The computer-executable program includes a first program that pre-registers a kind of a printing sheet designated by a user and determines whether a currently fed printing sheet belongs to the registered kind of the printing sheet depending on a feature value of the currently fed printing sheet, a second program that determines the kind of the currently fed printing sheet based on the feature value of the currently fed printing sheet and with reference to a predetermined identification table when it is determined in the first program that the currently fed printing sheet does not belong to the kind of the printing sheet registered by the user, and a third program that creates control data to control an operation of a head driver according to the kind of the currently fed printing sheet determined by the first and second programs.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
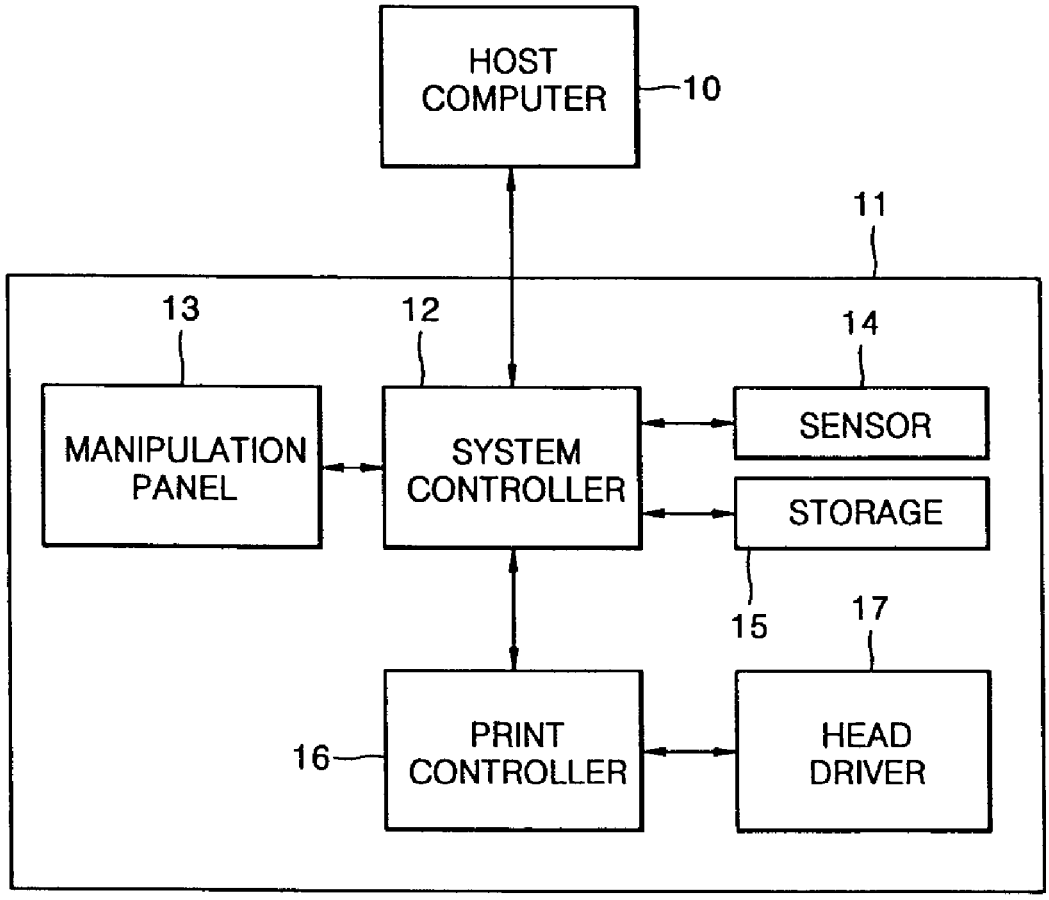
FIG. 1 is block diagram of a printing control system to perform a printing controlling method, in accordance with an aspect of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 is block diagram of a printing control system in accordance with an aspect of the present invention. The printing control system includes a host computer 10 and a printer 11. The printer 11 includes a system controller 12, a manipulation panel 13, a sensor 14, a storage 15, a print controller 16, and a head driver 17. Here, though it is not shown, the printer 11 further includes a carriage motor driver, a printing sheet carrier motor driver, and so forth.

Referring to FIG. 1, the host computer 10 transmits printing data written by a printer driver installed therein to the printer 11.

The system controller 12 of the printer 11 controls the overall operation of the printer 11 and includes a microprocessor type central processing unit (CPU: not shown), a read-only memory (ROM: not shown) which stores fixed data such as a control program or the like, and a random access memory (RAM: not shown) which stores the printing data and operation data of the system controller 12. In particular, the system controller 12 registers the kind of a printing sheet designated by a user, determines whether a currently fed printing sheet belongs to the registered kind according to a feature value of the currently fed printing sheet, and if the currently fed printing sheet does not belong to the registered kind, identifies the kind of the currently fed printing sheet based on the feature value of the currently fed printing sheet and with reference to an identification table included therein.

The manipulation panel 13 includes a key matrix (not shown) and a display (not shown). The key matrix creates data according to a key pressed by the user to designate each mode and operate the designated mode and outputs the data to the system controller 12. The display displays the operation state of the printer 11 when the system controller 12 performs each mode.

The sensor 14 is installed at a predetermined position of the printer 11 to detect the feature value of the fed printing sheet. The operation of the sensor 14 will be described with reference to FIG. 2.

Figure 2:
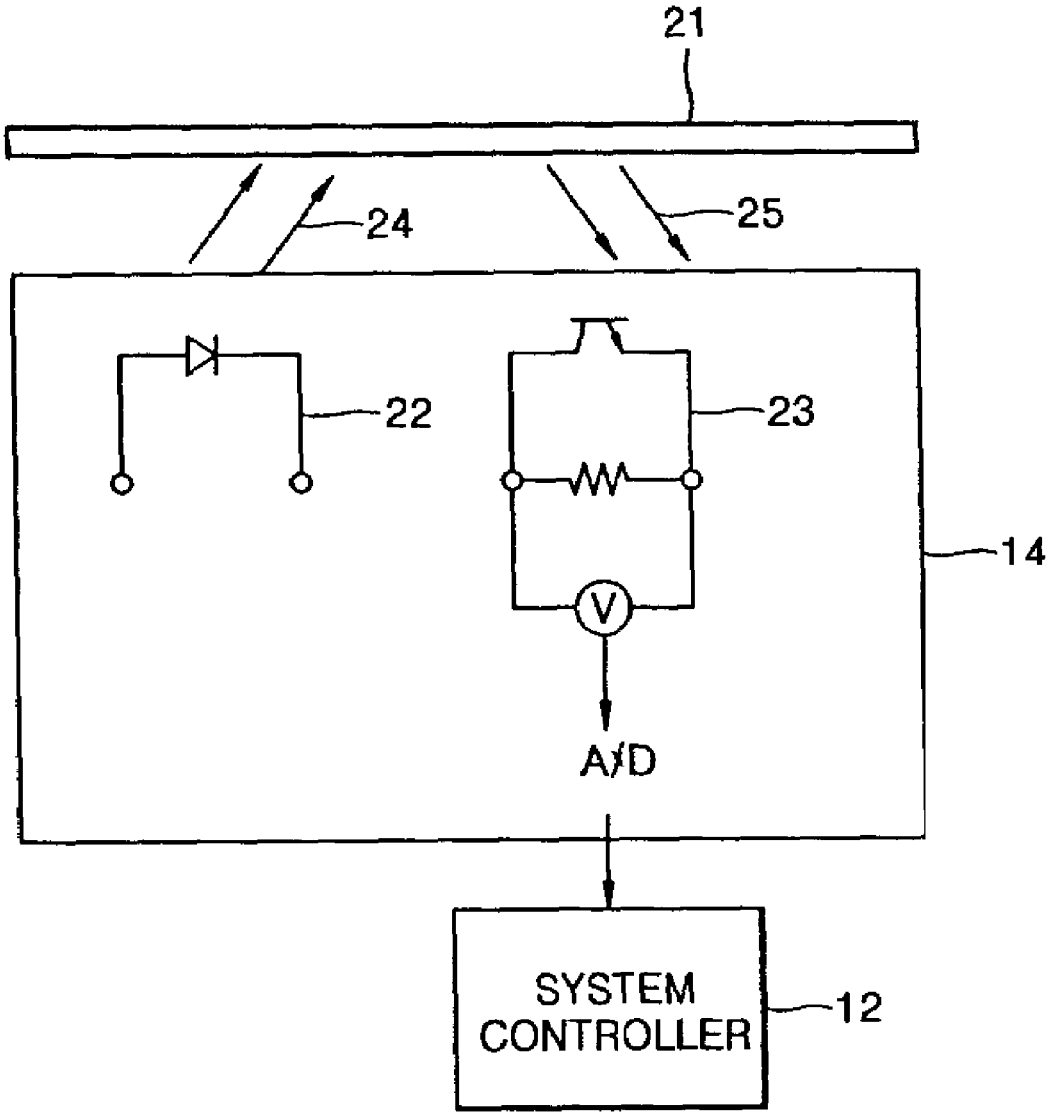
FIG. 2 is a detailed block diagram of a sensor shown in FIG. 1.

The sensor 14 includes an emitting unit 22 having a light emitting diode (LED) and other components, a receiving unit 23 having a photo transistor, among other components, and an analog-to-digital (A/D) converter. Referring to FIG. 2, the emitting unit 22 radiates light 24 having a predetermined strength onto a printing sheet 21. The receiving unit 23 receives light 25 reflected from the printing sheet 21 and converts an amount of the light 25 into a current. The A/D converter converts the current into a digital signal and provides the digital signal to the system controller 12.

When the user registers the kind of a printing sheet depending on one or more feature values of the printing sheet, i.e., the strength of reflected light 25 sensed by the sensor 14, in a printing sheet registration mode, the storage 15 tables and stores the feature value(s) and the kind of the printing sheets corresponding to the feature value(s).

The print controller 16 creates control data corresponding to the kind of the printing sheet determined by the system controller 12, controls the head driver 17 based on the control data, and forms an image on the printing sheet accordingly.

Figure 3:
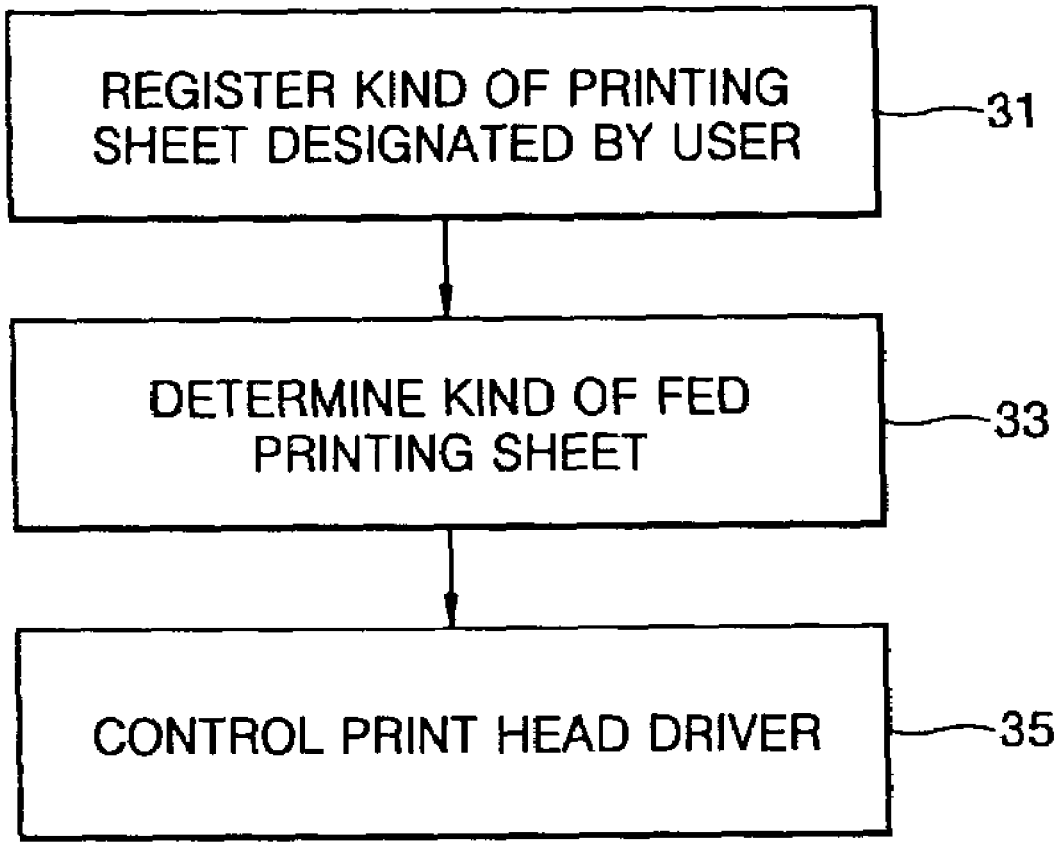
FIG. 3 is a flowchart illustrating a printing controlling method according to an aspect of the present invention.

FIG. 3 is a flowchart illustrating a printing controlling method according to an aspect of the present invention. The printing controlling method includes a printing sheet kind registration operation 31, a printing sheet kind determination operation 33, and a head driver control operation 35.

Referring to FIG. 3, in the printing sheet kind registration operation 31, one or more kinds of user printing sheets are registered and stored in the storage 15, together with feature values of the user printing sheets sensed by the sensor 14.

In the kind of fed printing sheet determination operation 33, a user gives a printing command for a document to be printed and the kind of a printing sheet fed into a feed tray (not shown) is determined from the feature value of the fed printing sheet provided from the sensor 14.

In the head driver control operation 35, the head driver 17 is controlled by the control data corresponding to the kind of the printing sheet determined in the kind of fed printing sheet determination operation 33. The control data may include a scanning speed of a head (not shown), an amount of discharged ink, a discharge pressure of ink, the number of used nozzles, and the like.

The printing sheet kind registration operation 31 of FIG. 3 will be described in more detail with reference to FIG. 4.

Figure 4:
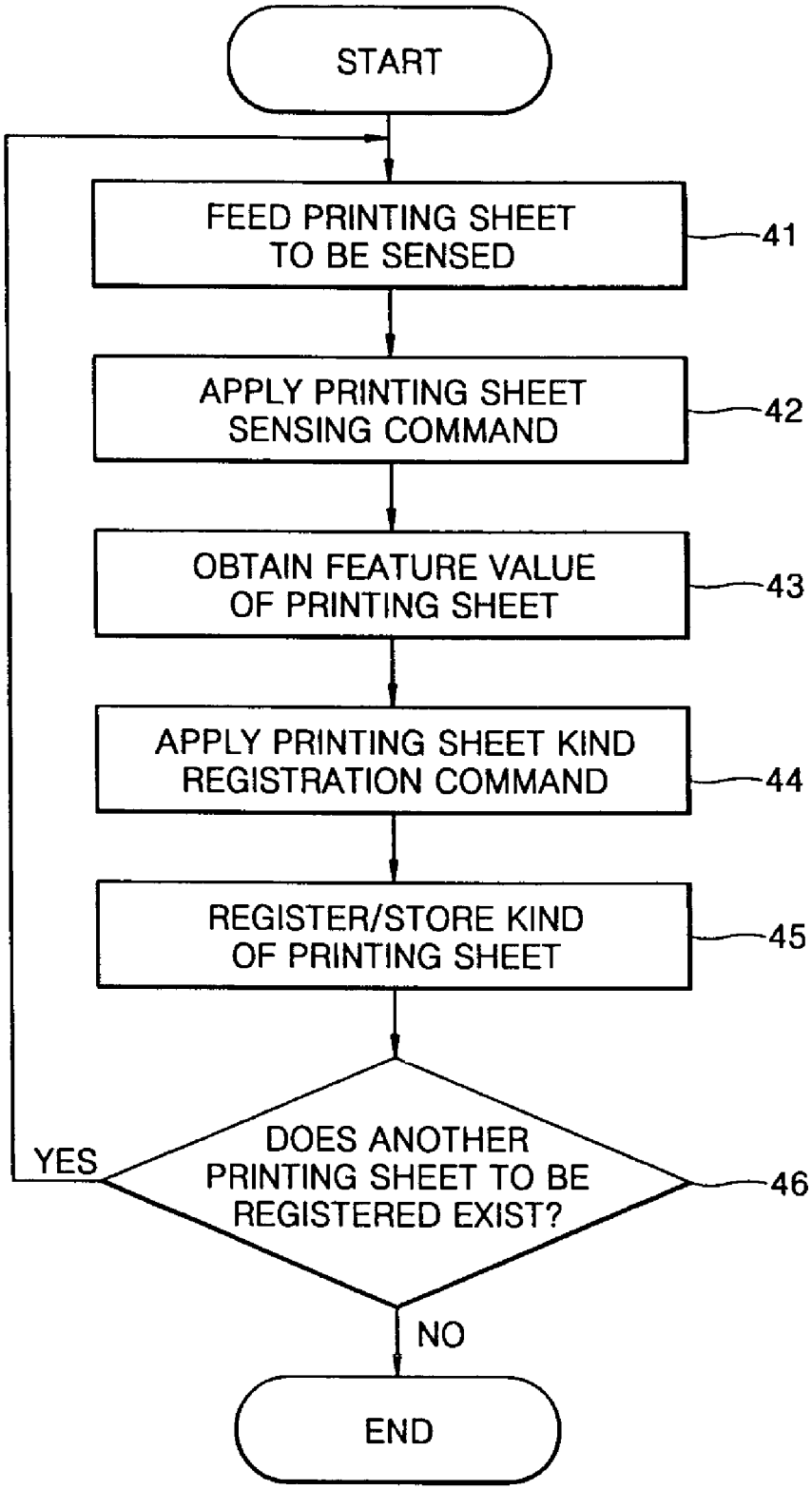
FIG. 4 is a flowchart illustrating a printing sheet kind registration of FIG. 3.

Referring to FIG. 4, in a printing sheet feed operation 41, a user printing sheet is fed into the feed tray (not shown). In a printing sheet sensing command application operation 42, a printing sheet sensing command is applied via a user interface provided by the printer driver of the host computer 10 or via the manipulation panel 13 of the printer 11. In a printing sheet feature value obtaining operation 43, light is radiated onto the printing sheet by controlling the emitting unit 22 of the sensor 14, and the feature value is obtained from reflected light received by the receiving unit 23.

In a printing sheet kind registration operation 44, a printing sheet registration command is applied to register the kind of the printing sheet corresponding to the feature value of the printing sheet in the printing sheet feature value obtaining operation 43. As in the printing sheet feed operation 41, in the printing sheet kind registration operation 44, the printing sheet registration command may be applied using the user interface provided by the host computer 10 and the manipulation panel 13 of the printer 11. For example, when the feature value of the printing sheet, i.e., a digital value of the reflected light, is "XXXX", the printing sheet is registered as a second kind, i.e., a glossy printing sheet.

In a printing sheet kind storage operation 45, the feature value in the printing sheet feature value obtaining operation 43 and the kind of the printing sheet in the printing sheet kind registration operation 44 are stored in the storage 15. In another printing sheet kind registration operation 46, it is determined whether another kind of printing sheet to be registered exists, and if the another kind of printing sheet does exist, the printing sheet feed operation 41 through the printing sheet kind storage operation 45 are repeated. However, if the another kind of printing sheet is determined not exist, the process ends.

The kind of fed printing sheet determination operation 33 and the head driver control operation 35 of FIG. 3 will be explained in more detail with reference to FIG. 5.

Figure 5:
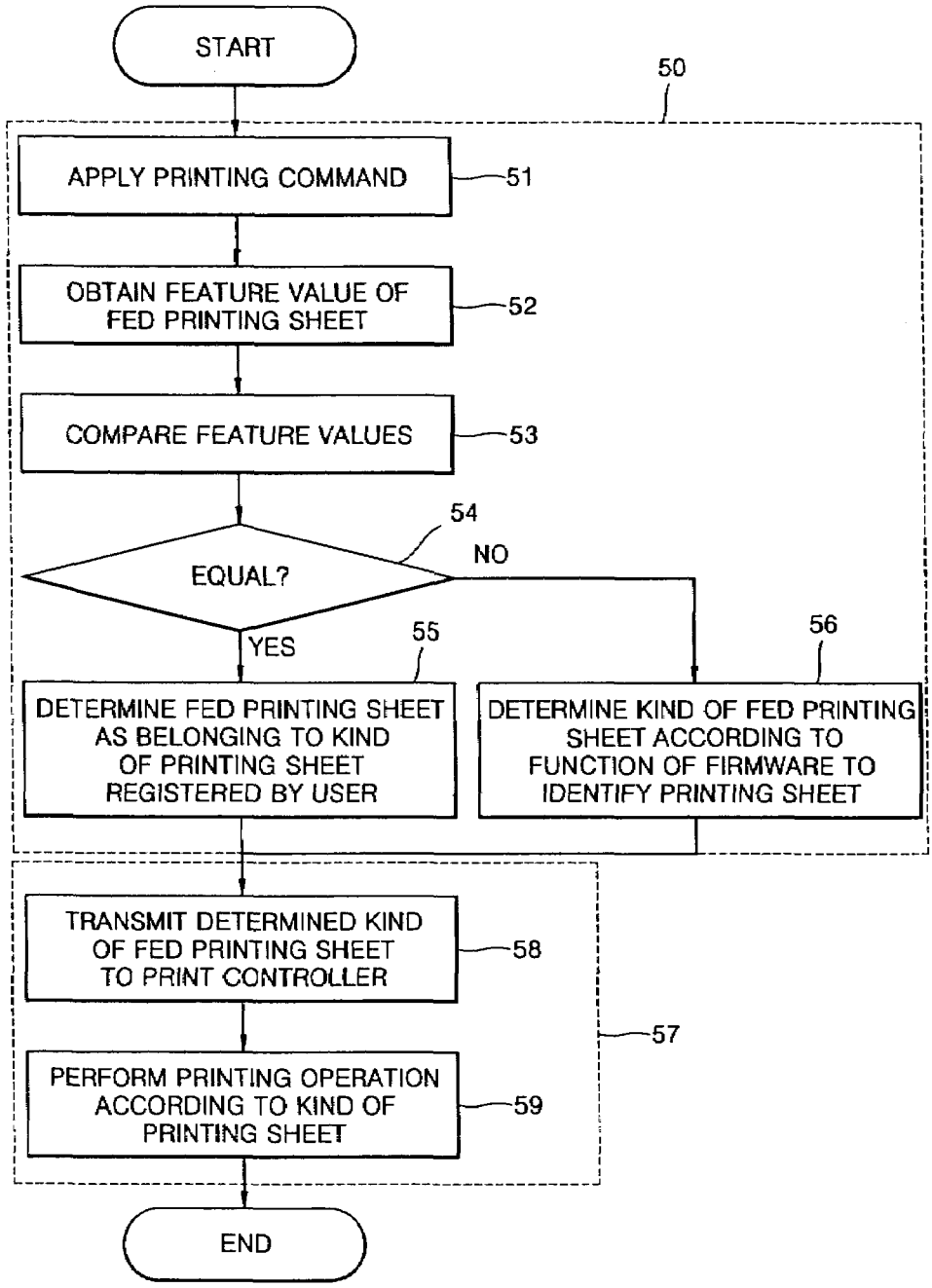
FIG. 5 is a flowchart illustrating a printing sheet kind determination and a head driver control of FIG. 3.

Referring to FIG. 5, in a printing command operation 51 of a printing sheet kind determination operation 50, the host computer 10 applies the printing command for a document to be printed by the user. In a printing sheet feature value obtaining operation 52, light is radiated onto the printing sheet fed to the feed tray by controlling the emitting unit 22 of the sensor 14, and the feature value is obtained from the reflected light received by the receiving unit 23.

In a feature value comparison operation 53, the feature value of the fed printing sheet in the printing sheet feature value obtaining operation 52 is compared with feature values registered by the user with reference to the printing sheet registration table stored in the storage 15. In an equal feature value determination operation 54, whether an equal feature value exists in the feature value comparison operation 53 is determined. If the equal feature value exists, in a kind of fed printing sheet determination operation 55, the fed printing sheet is determined as belonging to the kind of printing sheet corresponding to the feature value registered by the user. In a kind of fed printing sheet identification operation 56, if the equal feature value does not exist in the equal feature value determination operation 54, the firmware of the printer 11 identifies the kind of the fed printing sheet according to the feature value of the fed printing sheet and with reference to the identification table included therein.

In a printing sheet kind transmission operation 58 of a print head driver control operation 57, the kind of the fed printing sheet in the kind of fed printing sheet determination operation 55 or the kind of fed printing sheet identification operation 56 is transmitted to the print controller 16. In a printing operation 59, the control data is created based on the kind of the printing sheet in the printing sheet kind transmission operation 58 and the head driver 17 is driven based on the control data.

The above-described embodiments of the present invention can be written as programs which can be executed in a computer and can be realized in a general-purpose digital computer, which executes the programs, using computer-readable recording media. Computer-readable recording media include magnetic storage media such as ROMs, floppy discs, hard discs or the like, optical reading media such as CD-ROMs, DVDs, or the like, and storage media using carrier waves transmitted via the Internet.

As described above, according to the present invention, feature values and kinds of one or more kinds of user printing sheets are registered. Next, whether a printing sheet fed into a feed tray belongs to the registered kinds of the user printing sheets can be determined when a printing command is applied. If the fed printing sheet belongs to the registered kinds, the fed printing sheet can be determined as belonging to the registered kinds of the printing sheets. If the fed printing sheet is an unregistered printing sheet, the kind of the fed printing sheet can be determined in a general printing sheet identification process. As a result, the kind of the fed printing sheet can be accurately identified, which results in an image quality improvement effect.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of controlling a printing operation in an inkjet printer, comprising:

registering one or more kinds of user printing sheets along with feature values of the user printing sheets;

obtaining a feature value of a fed printing sheet to determine a kind of the fed printing sheet when a printing command is applied; and controlling a head driver according to the determined kind of the fed printing sheet, wherein the determination of the kind of the fed printing sheet comprises:

obtaining the feature value of the fed printing sheet when the printing command is applied, comparing the obtained feature value with the registered feature values, and determining the fed printing sheet as belonging to the registered kinds of the user printing sheets when the obtained feature value corresponds to the registered feature values.

2. The method of claim 1, wherein the feature value of the fed printing sheet corresponds to reflected light obtained from radiated light having a predetermined strength.

3. The method of claim 2, wherein the registration of the kinds of the user printing sheets with the feature values comprises:

applying a sensing command for the fed printing sheet;

obtaining a feature value of a printing sheet to be registered;

applying a printing sheet registration command; and registering and storing the obtained feature value and a kind of the printing sheet corresponding to the obtained feature value.

4. The method of claim 3, wherein the application of the sensing command is performed by one of a host computer providing printing data to the inkjet printer and a manipulation panel of the inkjet printer.

5. The method of claim 3, wherein the application of the printing sheet registration command is performed by one of a host computer providing printing data to the inkjet printer and a manipulation panel of the inkjet printer.

6. The method of claim 1, wherein the determination of the kind of the fed printing sheet further comprises:

identifying the kind of the fed printing sheet according to the feature value of the fed printing sheet and with reference to a predetermined identification table when the obtained feature value does not correspond to the registered feature values.

7. A computer-readable recording medium on which a computer-executable program is recorded, the computer-executable program comprising:

a first program that pre-registers a kind of a printing sheet designated by a user and determines whether a currently fed printing sheet belongs to the registered kind of the printing sheet depending on a feature value of the currently fed printing sheet;

a second program that determines the kind of the currently fed printing sheet based on the feature value of the currently fed printing sheet and with reference to a predetermined identification table when it is determined in the first program that the currently fed printing sheet does not belong to the kind of the printing sheet registered by the user; and a third program that creates control data to control an operation of a head driver according to the kind of the currently fed printing sheet determined by the first and second programs.

8. An apparatus to control a printing operation in an inkjet printer, comprising:

a sensor obtaining a feature value of a fed printing sheet;

a storage storing the feature value and the kind of user printing sheets corresponding to the feature value as a table;

a system controller registering one or more kinds of user printing sheets along with feature values of the user printing sheets and determining a kind of a fed printing sheet using a feature value of the fed printing sheet provided from the sensor and with reference to one of the table stored in the storage and an identification table included therein when a printing command is applied; and a print controller creating control data corresponding to the kind of the fed printing sheet determined by the system controller and controlling a head driver according to the control data.

9. A method of controlling a printing operation in an inkjet printer, comprising:

registering predetermined types of user printing sheets together with at least one characteristic feature thereof, including;

sensing a currently fed printing sheet together with at least one unique feature value thereof to be registered, applying a printing sheet registration command, and registering and storing the sensed at least one unique feature value and kind of printing sheet corresponding to the at least one unique feature value;

determining the kind of printing sheet fed to the inkjet printer upon a print command by comparing at least one characteristic feature of a fed printing sheet with the at least one characteristic feature of the registered user printing sheets; and controlling a head driver according to the determined kind of fed printing sheet.

10. The method of claim 9, wherein the operation of applying a printing sheet registration command is performed by one of a host computer providing printing data to the printer and a manipulation panel of the printer.

11. An apparatus to control a printing operation in a printer, comprising:

a sensor to sense at least one feature value of a fed printing sheet;

a system controller to register kinds of user printer sheets designated by a user together with at least one feature value thereof, and to determine whether a fed printing sheet belongs to the registered kind according to a feature value of the fed printing sheet, and if not, then determine the kind of the fed printing sheet based on the feature value of the fed printing sheet by referring to an identification table therein; and a print controller to control the head driver according to the determined kind of fed printing sheet.

12. The apparatus of claim 11, wherein the print controller controls the head driver by creating control data corresponding to the kind of fed printing sheet determined by the system controller and controlling the head driver accordingly.

13. The apparatus of claim 12, wherein the control data comprises data relating to at least one of a scanning speed of the head driver, an amount of ink to be discharged, a discharge pressure of ink, or a specific number of ink nozzles to be used.

14. The apparatus of claim 11, wherein the sensor comprises:

an emitting unit including a light emitting diode to emit light;

a receiving unit including a photo transistor to receive light reflected from the printing sheet and to convert the amount of light received into a current; and an analog-to-digital converter to convert the current into a digital signal to be provided to the system controller.

15. An apparatus to control a printing operation in a printer, comprising:

a sensing unit to emit light on one or more unregistered printing sheet types and to receive light reflected from the one or more unregistered printing sheet types to determine one or more unique feature values thereof;

a registration storage unit to register the one or more unregistered printing sheet types and to store the associated one or more unique feature values therein; and a controller to having access to both the registration storage unit and a pre-stored identification table, which is different from the registration storage unit and identifies pre-stored printing sheet types associated with pre-stored feature values.

16. The apparatus of claim 15, further comprising:

a head driver to drive a print head, wherein the controller controls one of a scanning speed of the head driver, an amount of ink to be discharged on a printing sheet, a discharge pressure of the ink, and a specific number of ink nozzles to be used according to head control data retrieved from one of the registration storage unit and the pre-stored identification table.

17. The apparatus of claim 15, further comprising:

a head driver to drive a print head, wherein the controller determines current one of the registered printing sheet types and controls the head driver according to the determined registered printing sheet type.

18. A method of controlling a printing operation of a specified printer, the method comprising:

detecting light reflected from a current printing sheet to determine a corresponding feature value;

determining whether a sheet type of the current printing sheet has been registered in the specified printer by determining whether the feature value that corresponds to the current printing sheet is stored in a registration storage unit of the specified printer; and retrieving print control data to print to the current printing sheet from the registration storage unit when it is determined that the sheet type thereof has been registered in the specified printer, and retrieving print control data to print the current printing sheet from a general printing sheet identification storage when it is determined that the sheet type thereof has not been registered in the specified printer.

19. A computer readable medium containing executable code to control a head driver of a printer, the medium comprising:

a first executable code to a sense one or more unique feature values of one or more unregistered printing sheet types;

a second executable code to control a registration storage unit to register the one or more unregistered printing sheet types with one or more associated unique feature values; and a third executable code to access at least one of the registration storage unit and a pre-stored identification table, which is different from the registration storage unit and identifies pre-stored printing sheet types associated with pre-stored feature values.

* * * * *